US011525267B2

(12) United States Patent
McGraw

(10) Patent No.: US 11,525,267 B2
(45) Date of Patent: Dec. 13, 2022

(54) LOCKING MECHANISM FOR SPINDLE

(71) Applicant: ARME Solutions, LLC, Barberton, OH (US)

(72) Inventor: Ryan McGraw, Wadsworth, OH (US)

(73) Assignee: ARME Solutions, LLC, Barberton, OH (US)

( * ) Notice: Subject to any disclaimer, the term of this patent is extended or adjusted under 35 U.S.C. 154(b) by 183 days.

(21) Appl. No.: 17/160,473

(22) Filed: Jan. 28, 2021

(65) Prior Publication Data

US 2022/0235558 A1 Jul. 28, 2022

(51) Int. Cl.
*E04F 11/18* (2006.01)

(52) U.S. Cl.
CPC ... *E04F 11/1817* (2013.01); *E04F 2011/1827* (2013.01)

(58) Field of Classification Search
CPC ..... E04F 11/18; E04F 11/181; E04F 11/1812; E04F 11/1817; E04F 11/1842; E04F 11/1844; E04F 11/1846; E04F 2011/1823; E04F 2011/1825; E04F 2011/1827
See application file for complete search history.

(56) References Cited

U.S. PATENT DOCUMENTS 4,045,003 A * 8/1977 McCluskey ..... E04F 11/1812 256/59
6,494,438 B1 * 12/2002 Noirot ..... E04F 11/1814 256/60
7,243,473 B2 * 7/2007 Terrels ..... E04C 3/32 52/843
7,971,412 B1 * 7/2011 Lim ..... E04F 11/1814 52/832
9,556,641 B2 * 1/2017 Milanowski ..... E04F 11/1842
10,961,731 B2 * 3/2021 Melic ..... F16B 13/0858
2005/0285091 A1 * 12/2005 Ko ..... E04H 17/1439 256/24
2006/0107613 A1 * 5/2006 Chung ..... E04F 11/1853 52/832
2007/0158630 A1 * 7/2007 Lo ..... E04F 11/181 256/59

(Continued)

FOREIGN PATENT DOCUMENTS

CN 108222389 A * 6/2018 ..... E04F 11/1817
CN 112064916 A * 12/2020 ..... E04F 11/181

(Continued)

*Primary Examiner* — Jonathan P Masinick
(74) *Attorney, Agent, or Firm* — Emerson Thomson Bennett; Roger D. Emerson, Esq.

(57) ABSTRACT

Provided in this disclosure is a selectively replaceable spindle for a banister. A generally longitudinal spindle body has a first end for engaging a first attachment portion on a surface of a handrail of a banister, and a second end for engaging a second attachment portion on an opposite surface from the handrail. A securement member is releasably secured with one or both of the first and second ends of the generally longitudinal spindle body. The securement member is urged into one of the first or second attachment portions to retain the spindle therein. One or more pins extend transversely from a side surface of the securement member, for engaging a cooperative structure on the spindle body to retain the securement member in a locked position.

13 Claims, 5 Drawing Sheets

(56) References Cited

U.S. PATENT DOCUMENTS

| | | | | |
|---|---|---|---|---|
| 2009/0200532 | A1* | 8/2009 | Platt | E04H 17/1447<br>256/67 |
| 2013/0068906 | A1* | 3/2013 | Chung | E04F 11/1846<br>248/222.14 |
| 2016/0281752 | A1* | 9/2016 | Koller | F16B 2/04 |

FOREIGN PATENT DOCUMENTS

| | | | | |
|---|---|---|---|---|
| KR | 100478179 | B1 | * | 3/2005 |
| KR | 20110100835 | A | * | 9/2011 |
| KR | 20110107272 | A | * | 9/2011 |
| KR | 20130030929 | A | * | 3/2013 |

* cited by examiner

LOCKING MECHANISM FOR SPINDLE

I. BACKGROUND

A. Technical Field

This invention pertains to the field of locking mechanisms for retaining removable items. In particular, the invention pertains to removable spindles for banisters alongside stairways and balconies.

B. Description of Related Art

In a typical stairway banister, vertical spindles are secured at either end between a transversely-mounted top handrail and a corresponding lower rail. In a typical arrangement, such banisters are commonly designed to be constructed and installed as permanent fixtures. As such, the spindles are typically hard mounted into the handrail and lower rail.

As described in co-pending application Ser. No. 16/987,785, entitled REMOVABLE SPINDLE FOR BANISTER, a banister design is contemplated which includes removable spindles, which can be selectively inserted and removed in between a handrail and lower rail. Such removable spindles can include different decorative designs and can be used to provide a banister with a variety of temporary or permanent decorative options without requiring complete disassembly of a banister, a laborious and expensive process.

A removable banister spindle should be easy to insert and remove while also being stable and secure when inserted between the handrail and lower rail. Removable spindles should also be stable and not rotate when installed.

II. SUMMARY

Provided in this disclosure is a selectively replaceable spindle for a banister having a generally longitudinal spindle body. A first end engages a first attachment portion on a surface of a handrail of a banister. A second end engages a second attachment portion on a surface of a bottom rail, opposite from the handrail. The first and second attachment portions can be cylindrical recesses formed into the respective surfaces of the handrail and bottom rail. These recesses receive the first and second ends so that the spindle removably extends between the handrail and the lower rail.

A securement member is releasably secured internally within a cavity formed in the selected first or second ends of the generally longitudinal spindle body. A biasing member is provided for urging the securement member into engagement with the respective attachment portions to retain the spindle therein. One or more pins are provided, extending transversely from a side surface of the securement member. The pins engage a cooperative structure on the spindle body to retain the securement member.

The securement member and the cavity can both be generally cylindrical. The groove can be formed transversely on a cylindrical internal surface of the cavity. The groove has a cylindrical profile to enable internal rotation of the pin. The groove can include a vertical portion connected to the respective one of the first or second ends of the spindle body, to enable the pin to exit the groove. In the preferred embodiment, the biasing member includes one or more coil springs.

The pin can include a pair of pins mounted at opposite ends of the side surface of the securement member. Each pin can be a spring-loaded push pin outwardly biased to extend outwardly from the side surface of the securement member.

The cooperative structure on the spindle body can be one or more mating holes in the spindle body for receiving a respective push pin. The push pin is received respectively in the mating hole to retain the securement member in the cavity. The push pin is depressed within the mating hole to enable the securement member to be displaced within the cavity for removal of the spindle from the respective one of the first or second attachment portions. Alternatively, the cooperative structure can be a groove formed on an internal surface of the cavity. The pin can be a rigid locking pin for rotatably engaging the groove with the securement member. The locking pin rotates within the groove to retain the securement member.

According to an aspect of the invention, a removable banister spindle is provided herewith that is easy to insert and remove.

According to another aspect of the invention, a removable banister spindle is provided herewith that is stable and secure when inserted between the handrail and lower rail.

According to still another aspect of the invention, a removable spindle is provided that is stable and does not rotate when installed.

Other benefits and advantages of this invention will become apparent to those skilled in the art to which it pertains upon reading and understanding of the following detailed specification.

III. BRIEF DESCRIPTION OF THE DRAWINGS

The disclosed selectively replaceable spindle may take physical form in certain parts and arrangement of parts, embodiments of which will be described in detail in this specification and illustrated in the accompanying drawings which form a part hereof and wherein.

IV. DETAILED DESCRIPTION

Figure 1A:
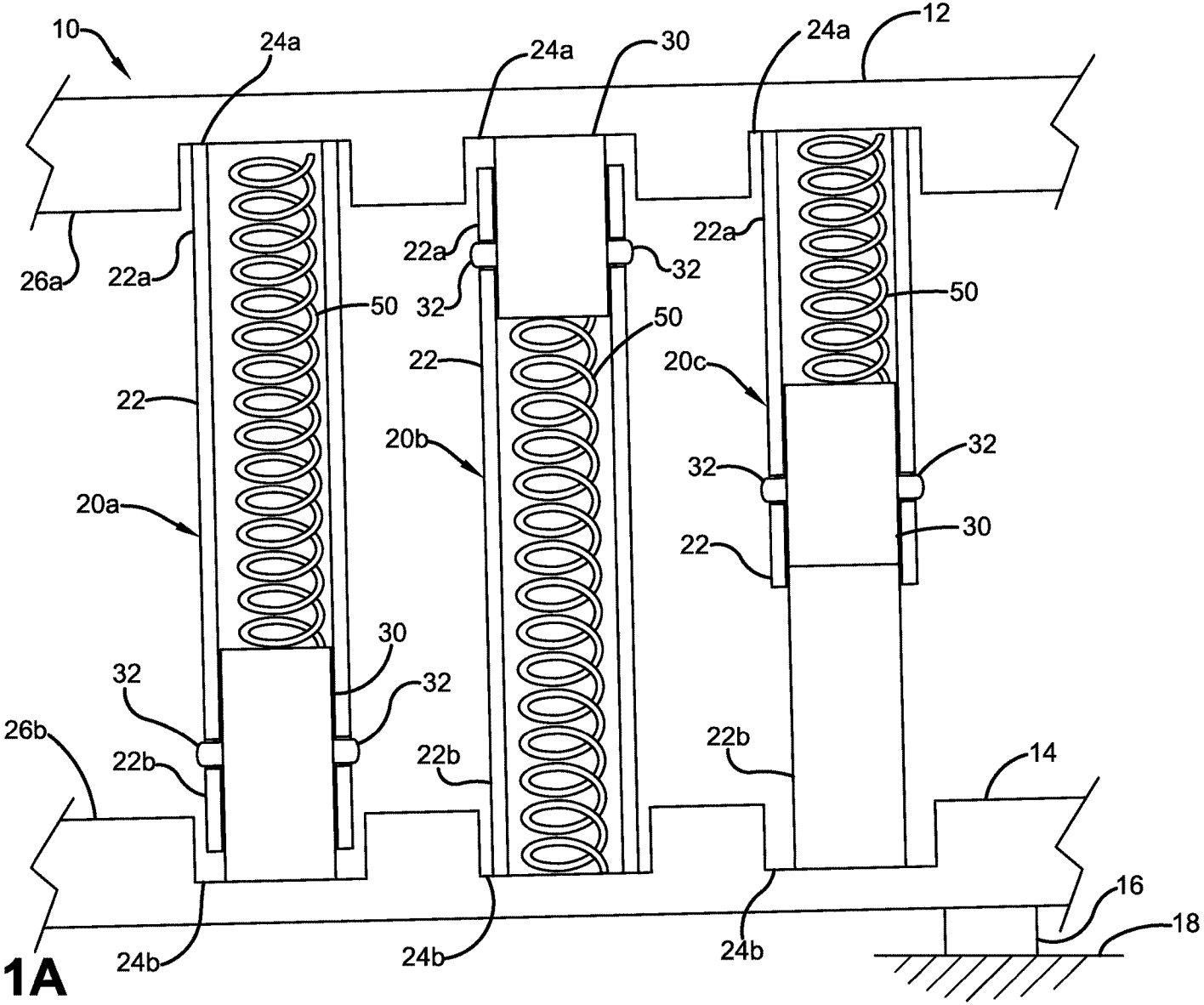
FIG. 1A is a side sectional view revealing the construction of a removable spindle for a banister in accordance with an exemplary embodiment of the present invention.

Referring now to the drawings wherein the showings are for purposes of illustrating embodiments of the article only and not for purposes of limiting the same, and wherein like reference numerals are understood to refer to like components:

As depicted in FIG. 1A, a banister 10 is generally disclosed including a handrail 12 and a lower rail 14 positioned opposite and generally parallel to the handrail 12. The lower rail 14 includes a plurality of bases 16 mounted on its underside which connect and support the banister 10 to a surface 18 such as a floor or a stairway, as understood in the art.

As also shown in FIG. 1A, a plurality of different spindles 20*a*, 20*b*, 20*c* are depicted, each spanning the distance between the handrail 12 and the lower rail 14, and secured to the handrail 12 and lower rail 14 (typically about 36 inches). Though the figure only depicts three different spindles 20*a*, 20*b*, 20*c* shown in a sectional view, it is to be appreciated that a banister 10 having a handrail 12 and a lower rail 14 of any desired length can be contemplated, thereby including an unlimited desired number of spindles of any type, all without departing from the invention.

As shown in FIG. 1A and throughout the drawings, each of the spindles 20*a*, 20*b*. 20*c* are a selectively replaceable spindle for a banister 10. The spindles 20*a*, 20*b*. 20*c* each include a generally longitudinal spindle body 22 having a first end 22*a* and a second end 22*h*. The first end 22*a* is configured for engaging a first attachment portion 24*a* on a surface 26*a* of the handrail 12 of the banister 10, where the surface 26*a* is an underside of the handrail, underneath the portion contacted by the hand of a user. The second end 22*b* of the spindle body 22 is configured for engaging a second attachment portion 24*b*, on an opposite surface 26*b* from the handrail 12. In the preferred embodiment, the opposite surface 26*b* from the handrail 12 is a top surface of the lower rail 14 including the second attachment portion 24*b* so that the spindle removably extends between the handrail and the lower rail. However, in an alternate embodiment, the opposite surface 26*b* can be the surface 18 such as a floor or stairway, with the second attachment portion 24*h* formed directly thereupon, for implementations in which the spindles 20*a*, 20*b*, 20*c* connect directly to the floor.

As also shown in FIG. 1A and throughout the drawings, in the preferred embodiment, one or more of the attachment portions 24*a*, 24*b* are recesses formed respectively into the surface 26*a* of the handrail 12 and the opposite surface 26*b* from the handrail 12, for respectively receiving the first and second ends 22*a*, 22*b*. The recesses 24*a*, 24*b* can be cylindrical bores or concave spherical indentations in the surfaces 26*a*, 26*b*, or any other suitable shape for receiving the first and second ends 22*a*, 22*b*. Accordingly, the first and second ends 22*a*, 22*b* can be convex in shape or any other suitable shape to form a stable, secure mating relationship with the recesses 24*a*, 24*b*. In an alternative embodiment, the attachment portions 24*a*, 24*b* can be a type of projection formed onto the surfaces 26*a*, 26*b*, to mate with a suitable concavity formed on the first and second ends 22*a*, 22*b*, all without departing from the invention.

Figure 1B:
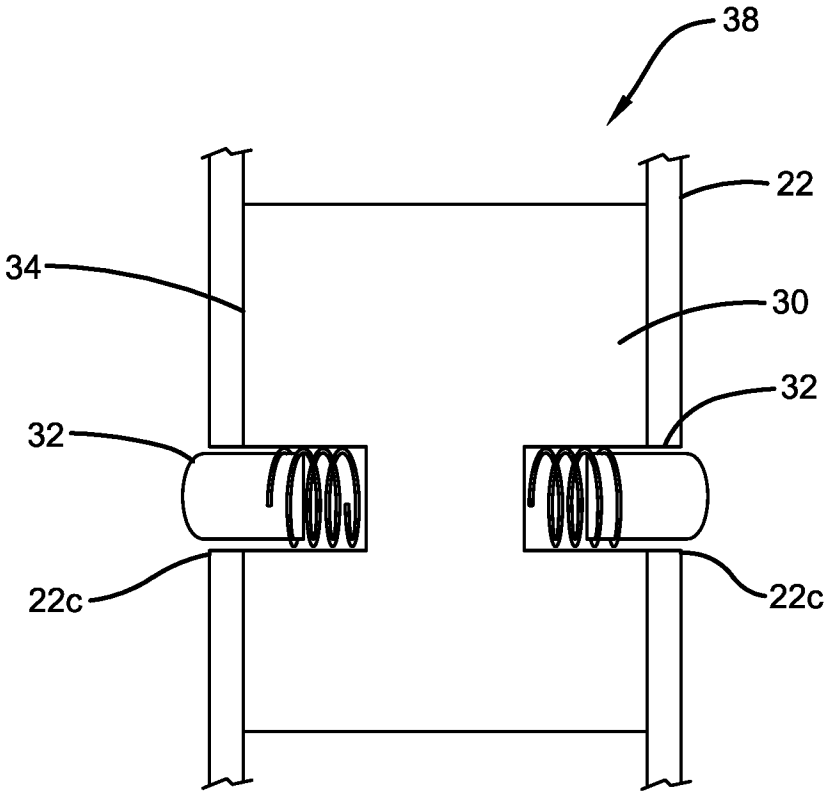
FIG. 1B is a zoomed in side sectional view of a securement member with push pins for the removable spindle for a banister as shown in FIG. 1A in accordance with an exemplary embodiment of the present invention.

As shown particularly in FIGS. 1A and 1B, a securement member 30 is releasably secured with one or both of the first or second ends 24*a*, 24*b* of the generally longitudinal spindle body 22. In the preferred embodiment, as illustrated, the spindle body 22 can be substantially hollow and the securement member 30 can be received and retained in either end or in the middle. The securement member 30 is urged into a respective one of the first or second attachment portions 24*a*, 24*b* to retain the respective spindle 20*a*, 20*b*, 20*c* therein, in order to hold and stably support the respective spindle 20*a*, 20*b*, 20*c*. As shown in FIG. 1A, for a first embodiment of the spindle 20*a*, the securement member 30 can be retained in the second end 24*b*. Alternatively, for a second embodiment of the spindle 20*b*, the securement member 30 can be retained in the first end 24*b*. In a third embodiment, the securement member 30 can be retained in the middle of the spindle 20*c* and the end 22*b* can be a separate component onto which the securement member 30 is affixed.

As also shown particularly in FIGS. 1A and 1B, one or more pins 32 are provided, extending transversely from a side surface 34 of the securement member. The pins 32 are provided for engaging a cooperative structure on the spindle body 22 to retain the securement member. In a preferred embodiment, the pins 32 are spring-loaded push pins 32 that are outwardly biased to extend outwardly from the side surface 34 of the securement member 30, In this embodiment, the cooperative structure on the spindle body 22 includes one or more mating holes 22*c* formed in the spindle body for receiving a respective push pin 32. The mating holes 22*c* can be formed by drilling or molding into the side of the spindle body 22. A push pin 32 is received respectively in a mating hole 22*c* to retain the securement member 30 internally within a cavity 38 formed in the respective one of the ends 22*a*, 22*b* of spindle body 22. When secured into the locked position, the push pins 32 are extended and securely reside within the mating holes 22*b* to securely retain the securement member 30, and thus retain the spindle 20*a*, 20*b*, 20*c*. To remove the spindle 20*a*, 20*b*, 20*c*, each push pin 32 are depressed within the mating hole 2 to enable the securement member 30 to be displaced and move inwardly within the cavity for removal of the spindle 20*a*, 20*b*, 20*c* from the respective one of the first or second attachment portions 24*a*, 24*b*.

Figure 2:
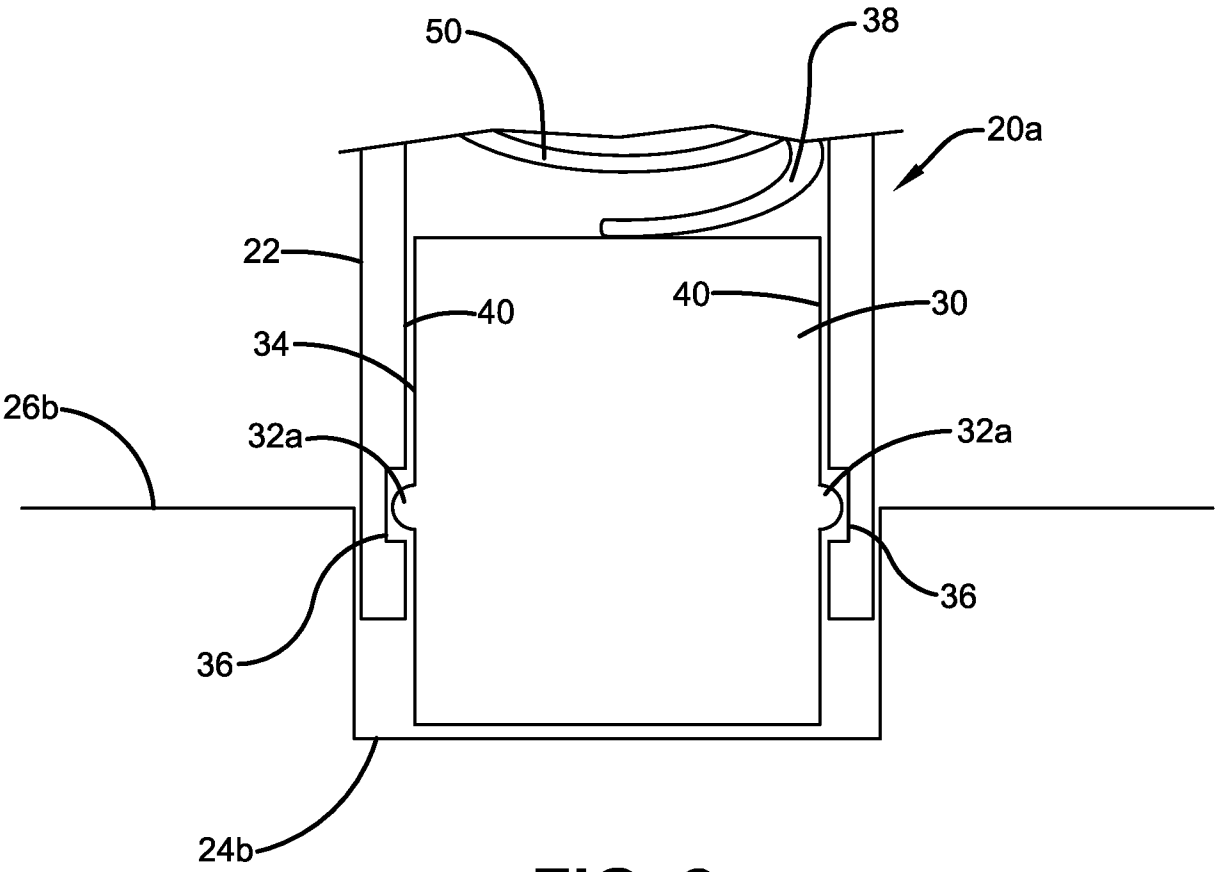
FIG. 2 is a zoomed in side sectional view of a securement member with locking pins for the removable spindle for a banister as shown in FIG. 1A in accordance with an alternative exemplary embodiment of the present invention.

In an alternative embodiment as shown in FIG. 2, the pins are rigid locking pins 32*a* that extend rigidly from the surface of the securement member 30 for rotatably engaging a groove 36 formed on an internal surface 40 in engagement with the securement member 30. The locking pins 32*a* rotate within the groove 36 to retain the securement member 30, as will be explained in greater detail hereinbelow. The locking pins 32*a* can be deployed in spindles of the types of spindles 20*a*, 20*b*, 20*c* shown in FIGS. 1A and 1B by making suitable adaptations as would be understood by those having skill in the art.

As shown in FIGS. 2A, 2B, 3A, and 3B, the securement member 30 is received internally within the cavity 42 formed in one or both of the first or second ends 22*a*, 22*b* of the spindle body 22. In the preferred embodiment, the securement member 30 and the cavity 42 are both generally cylindrical. The groove 36 is formed transversely on a cylindrical internal surface 40 of the cavity, such that the groove has a cylindrical profile to enable internal rotation of the locking pin 32*a*. As shown, a pair of locking pins 32*a* are provided, at opposite sides of the securement member 30. A corresponding pair of grooves 36 are formed, one for each of the two pins 32. The grooves 36 can be formed to provide a quarter turn of rotational movement or any other suitable amount of rotational movement. Also, any number of locking pins 32*a* and associated grooves 36 can be provided without departing from the invention.

As especially shown in FIGS. 2A, 2B, 3A and 3B, the grooves 36 also each include a vertical portion 44 connected to the respective one of the ends 22*a*, 22*b* of the spindle body 22 into which the securement member 30 is inserted. In this manner, the vertical portions 44 enable the locking pins 32*a* to enter and exit the grooves 36 from the respective end 22*a*, 22*b*.

As shown in FIGS. 1A, 2, 3B, 4A, and 4B, a biasing member 50 is included for urging the securement member 30 into the respective one of the first or second attachment portions 24*a*, 24*b* to retain the spindle 20*a*, 20*b*, 20*c* therein within the respective attachment portion 24*a*, 24*b*. In the preferred embodiment, the biasing member 50 is one or more coil springs 50. As is evident from the figures, the coil spring 50 applies a force against the securement member 30, which urges the first and second ends 22*a*, 22*b* firmly into the respective attachment portions 24*a*, 24*b*. The coil spring 50 is attached to the securement member 30 to retain it within the spindle 20*a*, 20*b*, 20*c* when removed from the first and second ends 22*a*, 22*b*.

In the preferred embodiment, one or both of the attachment portions 24*a*, 24*b* is a cylindrical recess formed into the respective surface of the handrail 12 and the opposite surface from the handrail 12, for respectively receiving the first and second ends 22*a*, 22*b*. In the preferred embodiment, the opposite surface from the handrail 12 comprises a facing surface of a lower rail 14 that includes the second attachment portion 24*b* so that the spindle 20*a*, 20*b*. 20*c* removably extends between the handrail 12 and the lower rail 14.

Figure 3B:
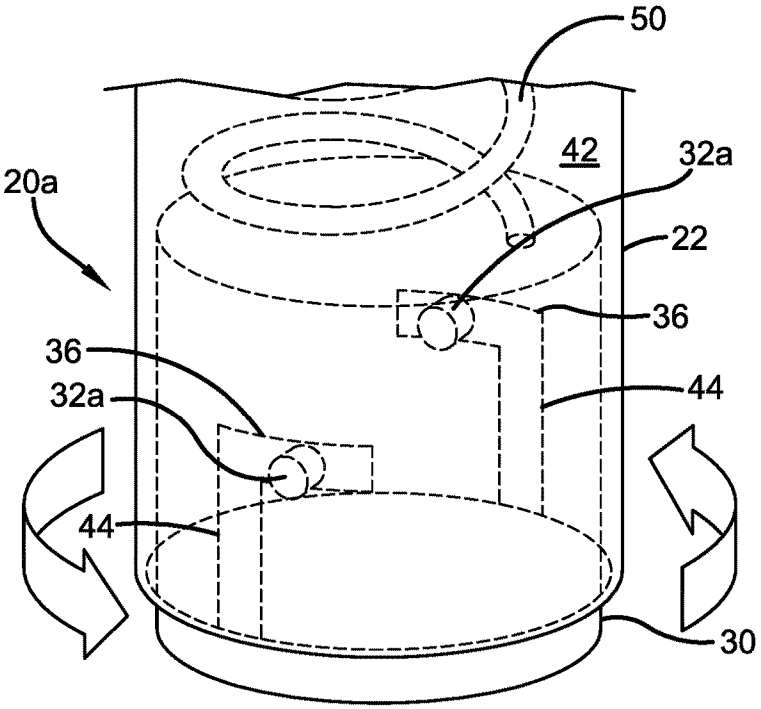
FIGS. 3A and 3B are sectional perspective views depicting the operation of the removable spindle using push pins in accordance with an alternative exemplary embodiment of the invention.
Figure 3A:
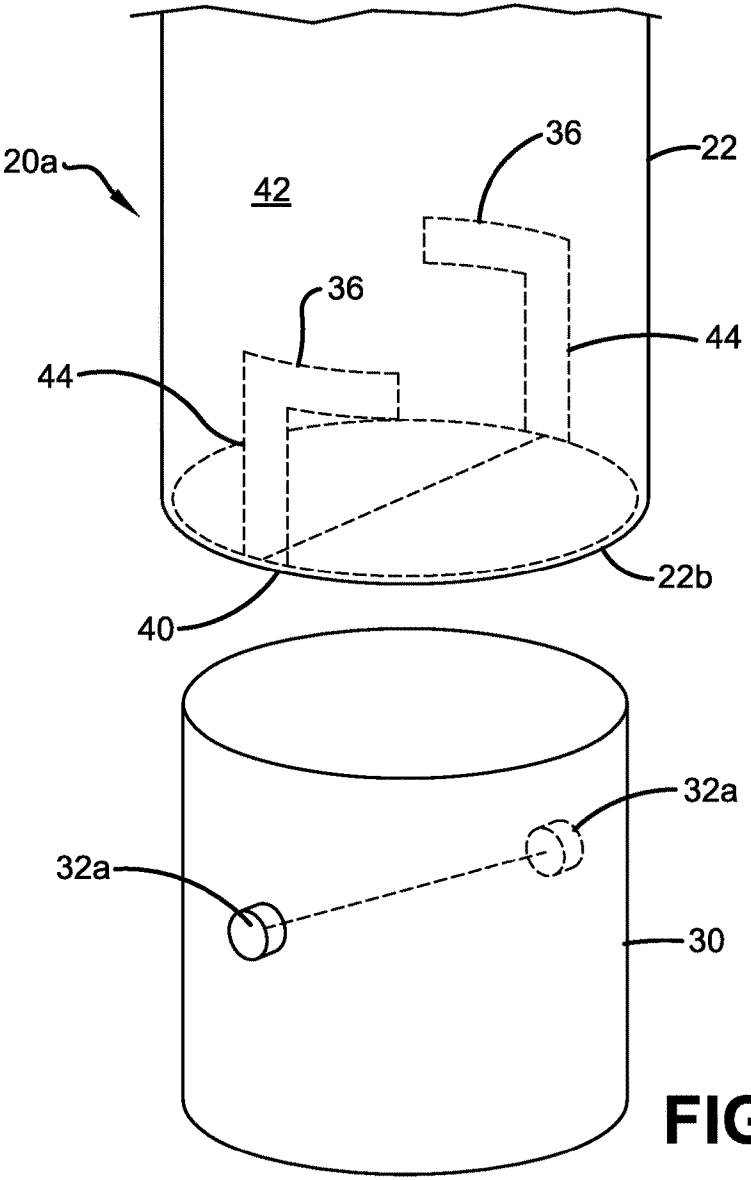

With specific reference to FIGS. 3A and 3B, the operation of the present spindle 20*a*, 20*b*, 20*c* is described herewith. The spindle 20*a*, 20*b*, 20*c* is inserted into a respective attachment portion 24*a*, 24*b* on the end 22*a*, 22*b* having the securement member 30. The securement member 30 is compressed so that the coil spring 50 is compressed enabling the other respective end 22*a*, 22*b* to be slid into its associated attachment portion 24*a*, 24*b*. The locking pins 32*a* are aligned within the lower area of the vertical portions 44 so that the locking pins 32*a* can slide freely up and down within the vertical portions 44. The spindle 20*a*, 20*b*, 20*c* is compressed so that the locking pins 32*a* travel up the vertical portions to encounter the grooves 36. The spindle 20*a*. 20*b*, 20*c* is rotated so that the locking pins 32*a* rotate transversely into grooves 36 until the locking pins 32*a* stop at the ends of the grooves 36. The grooves 36 can be made sufficiently long enough to allow for a quarter turn of travel, though any length would be suitable without departing from the invention. In this manner, the spindle 20*a*, 20*b*, 20*c* is retained since the securement member 30 is held firmly by the compression of the coil spring 50.

Figure 4B:
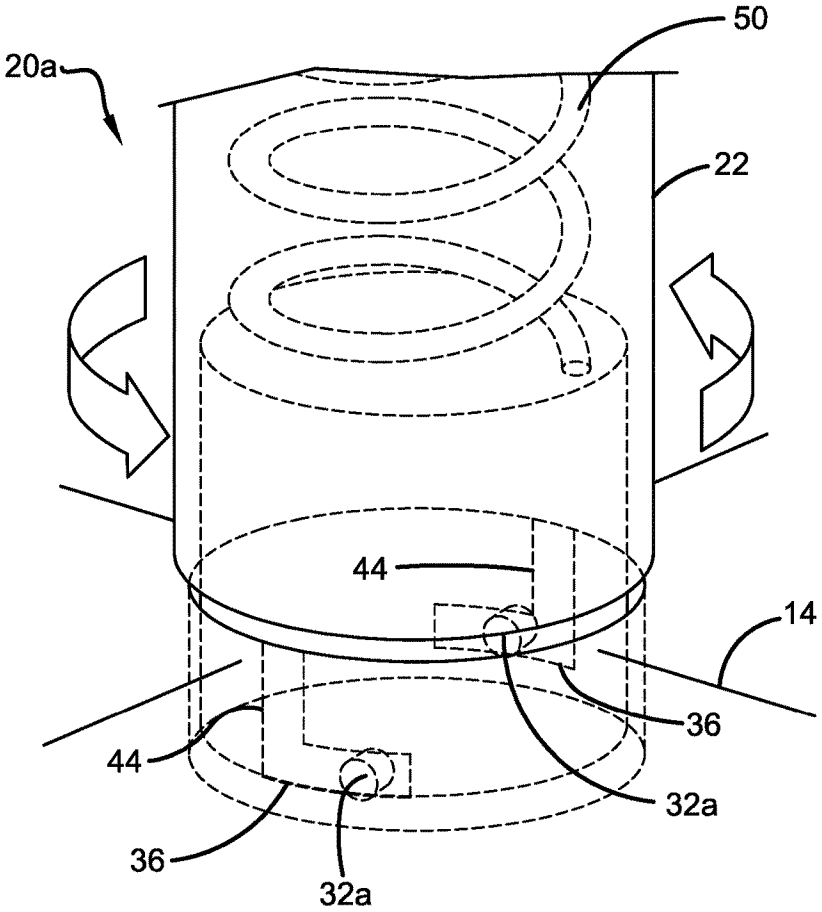
FIGS. 4A and 4B are sectional perspective views depicting the operation of the removable spindle using push pins in accordance with an alternative exemplary embodiment of the invention.
Figure 4A:
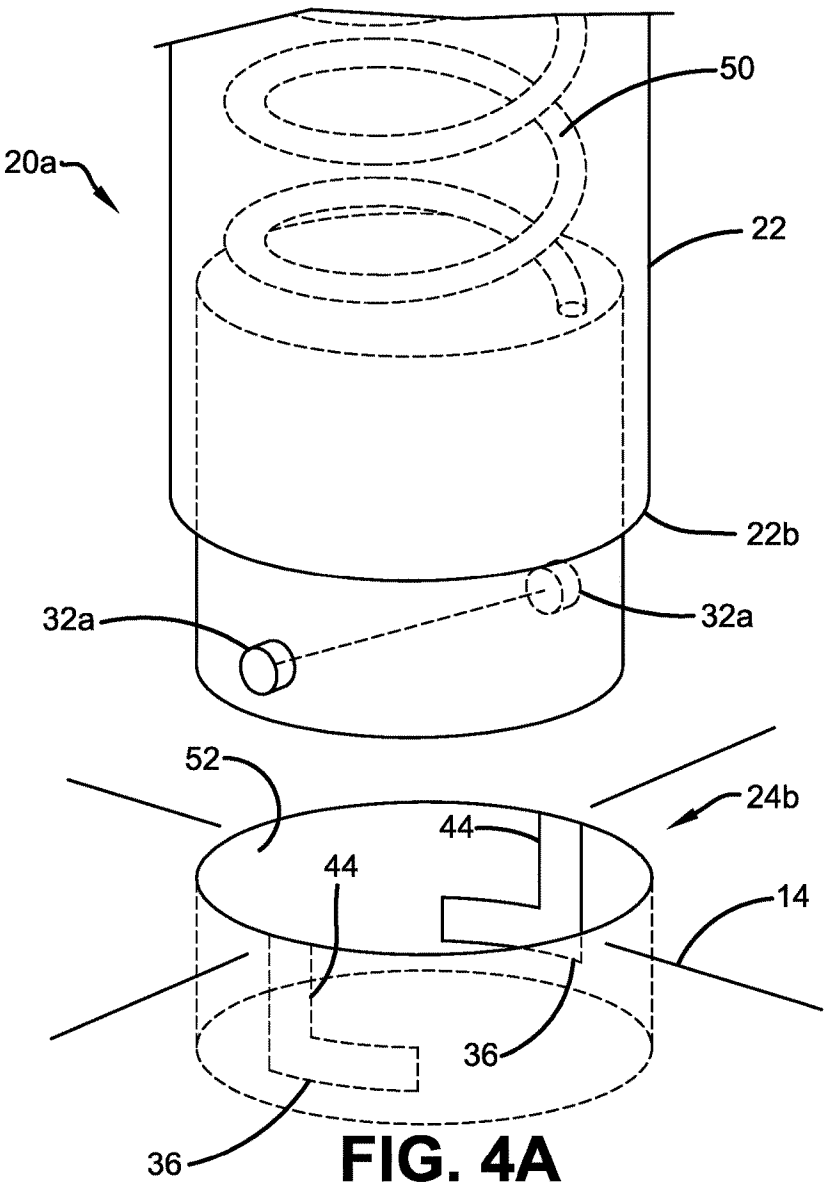

In the alternate embodiment of FIGS. 4A and 4B, the grooves 36 are formed on a cylindrical internal surface of the recess 52 of the first or second attachment portion 24*a*, 24*b*. The grooves 36 have a cylindrical profile to enable internal rotation of the locking pin 32*a* within the respective attachment portion 24*a*, 24*b*. The grooves 36 also include a vertical portion 44 formed on the cylindrical internal surface 52 of the respective attachment portion 24*a*, 24*b*, to enable the locking pins 32*a* to exit the grooves 36.

With specific reference to FIGS. 4A and 4B, the operation of the present spindle 20*a*, 20*b*, 20*c* according to the alternate embodiment is described herewith. The spindle 20*a*, 20*b*, 20*c* is inserted into a respective attachment portion 24*a*, 24*b* with the end 22*a*, 22*b* having the securement member 30. The securement member 30 is compressed so that the coil spring 50 is compressed enabling the other respective end 22*a*, 22*b* to be slid into its associated attachment portion 24*a*, 24*b*. The locking pins 32*a* are inserted into the vertical portions 44 formed in the cylindrical walls 52 of the respective attachment portion 24*a*, 24*b* so that the locking pins 32*a* can slide freely up and down within the vertical portions 44. The spindle 20*a*, 20*b*, 20*c* is compressed so that the locking pins 32*a* travel down the vertical portions to encounter the grooves 36. The spindle 20*a*, 20*b*, 20*c* is rotated so that the locking pins 32*a* rotate transversely into grooves 36 until the pins 32 stop at the ends of the grooves 36, thereby locking the spindle. In this embodiment the grooves 36 can also be made sufficiently long enough to allow for a quarter turn of travel, though any length would be suitable without departing from the invention. In this manner, the spindle 20*a*, 20*b*, 20*c* is retained since the securement member 30 is held firmly by the compression of the coil spring 50.

Numerous embodiments have been described herein. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof.

Having thus described the invention, it is now claimed:

1. A selectively replaceable spindle for a banister, comprising:

a generally longitudinal spindle body having a first end for engaging a first attachment portion on a surface of a handrail of a banister, and a second end for engaging a second attachment portion on an opposite surface from the handrail;

a securement member releasable secured with at least one of the first or second ends of the generally longitudinal spindle body, wherein the securement member is urged into one of the first or second attachment portions to retain the spindle therein; and at least one pin, extending transversely from a side surface of the securement member, for engaging a cooperative structure on the spindle body to retain the securement member.

2. The selectively replaceable spindle of claim 1, wherein the securement member is received internally within a cavity formed in at least one of the first or second ends of spindle body.

3. The selectively replaceable spindle of claim 2, wherein the at least one pin comprises at least one spring-loaded push pin outwardly biased to extend outwardly from the side surface of the securement member, wherein the cooperative structure on the spindle body comprises at least one mating hole in the spindle body for receiving the at least one push pin, wherein the at least one push pin is received respectively in the at least one mating hole to retain the securement member in the cavity and wherein the at least one push pin is depressed within the at least one mating hole to enable the securement member to be displaced within the cavity for removal of the spindle from the respective one of the first or second attachment portions.

4. The selectively replaceable spindle of claim 2, wherein the cooperative structure comprises a groove formed on an internal surface of the cavity, wherein at least one pin is a rigid locking pin for rotatably engaging the groove with the securement member, wherein the locking pin rotates within the groove to retain the securement member.

5. The selectively replaceable spindle of claim 4, wherein the securement member and the cavity are both generally cylindrical and wherein the groove is formed transversely on a cylindrical internal surface of the cavity, such that the groove has a cylindrical profile to enable internal rotation of the locking pin.

6. The selectively replaceable spindle of claim 5, wherein the groove further comprises a vertical portion connected to respective one of the first or second ends of the spindle body, to enable the locking pin to exit the groove.

7. The selectively replaceable spindle of claim 4, wherein at least one of the first and second attachment portions is a cylindrical recess formed into the respective surface of the handrail or the opposite surface from the handrail, for respectively receiving the first and second ends, wherein the groove is formed on a cylindrical internal surface of the recess, such that the groove has a cylindrical profile to enable internal rotation of the locking pin.

8. The selectively replaceable spindle of claim 1, further comprising a biasing member for urging the securement member into one of the first or second attachment portions to retain the spindle therein.

9. The selectively replaceable spindle of claim 8, wherein the biasing member comprises at least one coil spring.

10. The selectively replaceable spindle of claim 1, wherein the opposite surface from the handrail comprises a surface of a lower rail including the second attachment portion so that the spindle removably extends between the handrail and the lower rail.

11. A selectively replaceable spindle for a banister, comprising:

a generally longitudinal spindle body having a first end for engaging a first attachment portion on a surface of a handrail of a banister, and a second end for engaging a second attachment portion on a surface of a bottom rail, opposite from the handrail, wherein the first and second attachment portions are cylindrical recesses formed into the respective surfaces of the handrail and bottom rail, for respectively receiving the first and second ends so that the spindle removably extends between the handrail and the lower rail;

a securement member releasably secured internally within a cavity formed in at least one of the first or second ends of the generally longitudinal spindle body;

a biasing member for urging the securement member into engagement with the respective one of the first or second attachment portions to retain the spindle therein; and at least one spring-loaded push pin outwardly biased to extend outwardly from the side surface of the securement member;

at least one mating hole in the spindle body for receiving the at least one push pin to retain the securement member in the cavity, wherein the at least one push pin is depressed within the at least one mating hole to enable the securement member to be displaced within the cavity for removal of the spindle from the respective one of the first or second attachment portions.

12. The selectively replaceable spindle of claim 11, wherein the biasing member comprises at least one coil spring.

13. The selectively replaceable spindle of claim 11, wherein the at least one push pin comprises a pair of push pins mounted at opposite ends of the side surface of the securement member that cooperate with a respective pair of mating holes formed on opposite sides of the spindle body.

* * * * *